United States Patent [19]

Ehrich

[11] Patent Number: 4,833,798

[45] Date of Patent: May 30, 1989

[54] HYDRAULIC CONTROL FOR EARTH WORKING MACHINES

[75] Inventor: Gerd Ehrich, Monheim, Fed. Rep. of Germany

[73] Assignee: Mannesmann AG, Duesseldorf, Fed. Rep. of Germany

[21] Appl. No.: 206,102

[22] Filed: Jun. 13, 1988

[30] Foreign Application Priority Data

Jun. 11, 1987 [DE] Fed. Rep. of Germany ..... 3719752
May 17, 1988 [DE] Fed. Rep. of Germany ..... 3817218

[51] Int. Cl.[4] ..... E02F 5/02; F15B 11/08

[52] U.S. Cl. ..... 37/103; 91/420; 91/461; 60/452; 60/461; 137/596.15; 137/625.6; 280/90; 37/DIG. 7; 37/DIG. 9

[58] Field of Search ..... 37/103, 124, 126 R, 37/129, DIG. 1, DIG. 7, DIG. 9, DIG. 10, DIG. 11, 446; 91/454, 455, 461, 462; 60/461, 489; 137/596.15, 625.6, 625.63, 625.3, 625.66; 280/419, 776, 89, 90

[56] References Cited

U.S. PATENT DOCUMENTS

| | | | |
|---|---|---|---|
| 3,862,643 | 1/1975 | Dezelan et al. | 137/625.63 |
| 3,935,792 | 2/1976 | Dezelan et al. | 91/438 |
| 4,201,052 | 5/1980 | Breeden et al. | 60/445 |
| 4,353,289 | 10/1982 | Lonnemo | 91/420 |
| 4,407,122 | 10/1983 | Nanda | 60/452 |
| 4,475,442 | 10/1984 | Breeden | 91/461 |
| 4,480,527 | 11/1984 | Lonnemo | 91/436 |
| 4,611,527 | 9/1986 | Breeden | 91/420 |
| 4,724,673 | 2/1988 | Curnow | 91/461 |
| 4,753,157 | 6/1988 | Lonnemo et al. | 137/596.15 |

*Primary Examiner*—Eugene M. Eickholt
*Attorney, Agent, or Firm*—Ralf H. Siegemund

[57] ABSTRACT

The hydraulic control is constructed for time-sharing of the pump which normally controls the turning mechanism, to operate other hydraulic equipment in conjunction with other pumps.

1 Claim, 1 Drawing Sheet

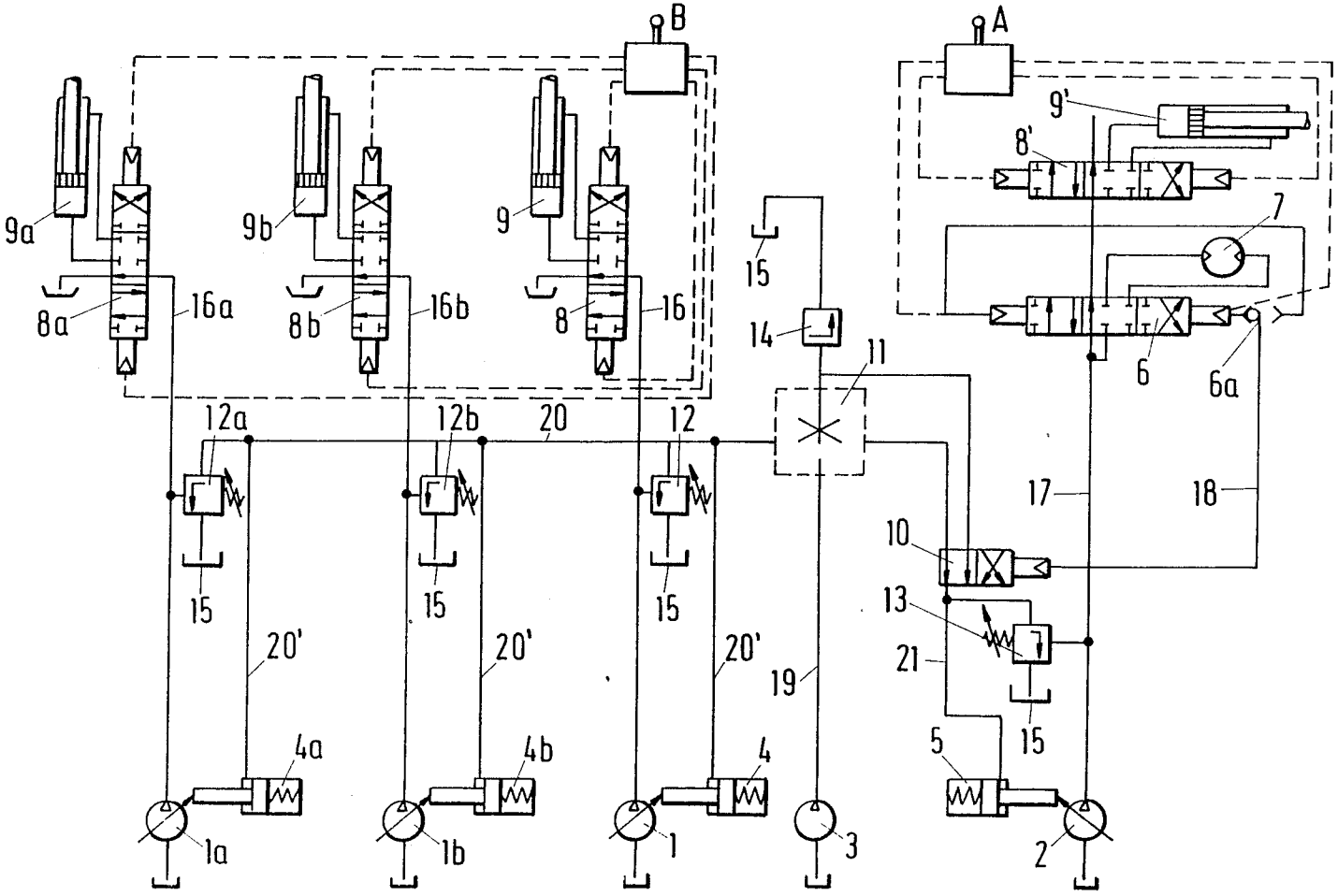
A
B
1
1a
1b
2
3
4
4a
4b
5
6
6a
7
8
8a
8b
8'
9
9a
9b
9'
10
11
12
12a
12b
13
14
15
16
16a
16b
17
18
19
20
20'
21

HYDRAULIC CONTROL FOR EARTH WORKING MACHINES

BACKGROUND OF THE INVENTION

The present invention relates to a hydraulic control system for hydraulically-operated excavators, shovels, or other similar heavy-duty earth-working machines. These machines use a plurality of fluid pumps, at least one of which being associated to the turning device of the earthworking machine, turning it around a vertical axis, while the others are associated with other power equipment such as the drive-wheels, power tools, and so forth, all being operated by hydraulic cylinder piston-drives in more or less similar arrangements.

Hydraulic control systems of the type to which the invention pertains, for example, are shown at least in parts in German Printed Patent Application No. 16,34,790. The control system as therein described includes a switch valve associated with an arrangement in the discharge line of the turning equipment so as to avoid that the pump operating the turning facilities has to work against the pump of the other hydraulic cylinder and piston arrangement therein. The switching valve will change position upon the occurence of a particular pressure differential. That differential pressure may have different causes. If the switching valve is not operated, the motors on the feed as well as on the discharge sides are simultaneously operated at a high pressure, and that, of course, is impractical and disadvantageous from the point of view of the use-life of these motors.

In the case of hydraulic excavators with a three-circuit hydraulic system, one usually employs two pumps for the power tools, and a separate circuit for turning the excavator. The turning equipment is associated with a pump and will just idle along when not turning the equipment. Since separate and different control characteristics are necessary for the different tasks and purposes and therefore circuits, this three-circuit hydraulic arrangement must reflect these differences in control tasks and operating characteristics.

DESCRIPTION OF THE INVENTION

It is an object of the present invention to provide a new and improved hydraulic system for hydraulic excavators or the like, such that a switch-over of the pump of the turning equipment is possible to participate in the hydraulic piston arrangement or arrangements that are working elsewhere in the system without interference and with little expenditure.

It is a specific object of the present invention to improve on the relationship between hydraulic control devices and users in earthworking machines.

In accordance with the preferred embodiment of the present invention, it is suggested to provide a plurality of similar pressure pumps, similar in the sense that they have similar adjustment characteristics, which pumps are held (biased) by spring means to a small pivot angle; a load limit valve is provided to generate a control pressure for acting against the respective springs of the spring means in the respective pumps; the load limit valve receives pressure medium (oil) by means of a pressure rising pilot pump, in order to produce a speed-dependent control pressure which increases with increasing speed of the respective pressure pumps and causing the respective pump to pivot as stated, for purposes of increasing the amount of pressurized medium that passes through and is worked on by the pump; each pressure pump, moreover, is associated with a pressure valve by means of which the load-limit valve, as far as its control pressure is concerned, is connected to the respective pressure pump individually and pressureless as far as the supply is concerned; whenever the operating and working pressure of the respective pump within the conduit that includes the respective pressure valve exceeds a maximum adjusted working pressure, so that owing to the spring bias in the respective pump, that pump pivots back and reduces the amount of fluid passing through until the working pressure drops below the adjusted pressure value; furthermore, a control circuit is provided for a first one of the pumps being, moreover, associated with the turning mechanism of the machine, there being an auxiliary valve provided which on movement of the pivot drive in the first pressure pump, separate that pump from the load-limit valve and, in the alternative, constant control pressure is applied to that pump which causes that first pump to be adjusted towards maximum pivot angle and therefore maximum fluid to be moved; the pressure valve associated with that first pump causes that pump to receive pressure fluid at a predetermined pressure just sufficient to accelerate the turning mechanism up to speed while the residual power of this first pump and its drive is being made useful and useable by the other pumps of the plurality working on other users.

It can thus be seen that the pumps all operate with the same kind or type of controller, each being suitable for operating with one and the same load limit valve. In the case of a drastic pressure drop at the throttle-point of the load-limit valve, the pumps adjust towards a large amount of fluid to be conveyed. A conduit is run from the switch-over valve and slide pertaining to the turning equipment, to an auxiliary valve which is connected in between the first pump and load-limit valve, the latter being connected to the control of the pump.

Whenever the (human) operator moves the control slide connecting the first pump to the turning equipment, the auxiliary valve is likewise operated and now the adjustment of the turning equipment pump is separated from the load-limit valve. The control pressure that is now effective causes the turning-equipment pump to shift to the maximum fluid flow. As long as the turning equipment is not yet in a condition to assume and accept the full amount that is conveyed by the pump, there is a limiting of that amount through its pressure-control valve by means of which the control-pressure is diminished in the control line. This control pressure is effective for adjusting the pump for reducing the then-effective quantity as conveyed by the pump. If more liquid is taken up by the turning equipment, the adjustment is modified accordingly.

The advantages of the inventive-control system can be summarized as follows. The turning equipment as well as the working tools can utilize identical kinds and types of pumps and control equipment which means that the pumps can be easily exchangeable so that the construction is more economical simply because of similarity of components. Three different kinds of motion, e.g. of boom, tower and shovel, can be moved independently from each other and with full pressure. The power of the equipment for the turning can be utilized in other tools whenever turning of the boom on the vertical axis is not desired. The particular pump that operates the turning equipment when needed is no longer an idle load. That pump is subjected to a constant pressure of, for example, 300 bars, which means that high acceleration is obtainable. It was found that as compared with conventional comperable hydraulic excavators, the fuel consumption is lower by about 20%.

DESCRIPTION OF DRAWINGS

While the specification concludes with claims particularly pointing out and distinctly claiming the subject matter which is regarded as the invention, it is believed that the inventions, the objects and features of the invention and further objects, features and advantages thereof will be better understood from the following description taken in connection with the accompanying drawings in which:

The FIGURE shows somewhat schematically equipment for practicing the preferred embodiment in accordance with best mode principles of operation.

The particular hydraulic excavator, dredge, shovel or the like, to which the invention pertains, is operated by a control person using control sticks in control boxes A and B. On moving and operating stick A, electrical control signals are generated and transmitted through electrical conductors such as A1 to provide the adjustment of turning equipment 7 for the machine. Specifically, certain signals from control box A shift a control slide 6 in one direction or the other so that hydraulic fluid is supplied to the turning mechanism 7 for operating it in one direction or the opposite one, or stopping and holding it, etc.

In addition, other control signals from box A are received by a switching-valve 6*a*. An auxiliary valve 10 is operated by the valve 6*a* and receives therefrom a signal through a line 18. Valve 10 selectively establishes a connection to the controller 5 of a pump 2, either from a load-limit valve 11 or from a source of constant initial pressure established by control and stop valve 14.

The pump 2 is first one of a plurality of pumps and has as a primary function the operation of mechanism 7, but will double up otherwise as will be explained. Reference numerals 1, 1*a* and 1*b* refer to additional pumps of the plurality. They respectively apply pressurized fluid through the valve slides 8, 8*a* and 8*b* respectively to the cylinders of piston-cylinder drives 9, 9*a* and 9*b*. Accordingly, conduits 16, 16*a* and 16*b* to provide for the connection.

Pump 2 is provided primarily for operating the turning equipment 7. Pump 2 feeds pressurized hydraulic fluid via a conduit 17 to the control slide 6 for operating the turning device 7. Depending on the position of slide 6, control and operation of the turning equipment 7 obtain or not. The latter is the illustrated case. As long as the control slide 6 is not actuated and shifted out of the illustrated position, the connection to mechanism 7 is blocked, and the pump 2 feeds fluid through one or several of the control slides 8$^1$ to actuate (in addition) a working cylinder 9$^1$, or any of the other operating cylinders and drives 9, 9*a* or 9*b*. This then is an auxiliary pressurization for operating this equipment.

A control line 18 runs from the valve 6*a* to the auxiliary valve 10 being interposed in a conduit 21 that extends between the load-limit valve 11 and the adjustment structure 5 for the pump 2. A pressure switch-valve 13 is provided between the conduit and line 21, and the conduit 17. Similarly-constructed pressure valves 12, 12*a* and 12*b* are arranged respectively between the conduits 16, 16*a* and 16*b* on one hand, and the manifolded branch lines 20, and 20$^1$ on the other hand. The lines 20$^1$ control adjusting devices 4, 4*a* and 4*b* which respectively control the working-pumps 1, 1*a* and 1*b* of the working piston cylinder drives 9, 9*a* and 9*b*. A pilot pump 3 feeds pressurized fluid to the load-limit valve 11 and a connection therefrom runs from a stop-valve 14 to the tank 15 to which are also connected the discharge outlets of valve/slides 8$^1$, 8, 8*a* and 8*b*.

Pumps 1, 1*a* and 1*b* are the principle and usual main working pumps for operating various parts (tools, wheels, etc.) of the excavating and shovel machine. A great deal of versatility is known here and in principle these aspects are adopted; the invention is not related to the limiting of any use but to an expansion of the existing possibilities and facilities, so that known employment is readily adoptable here.

Contrary to many aspects in the prior art, however, pumps 1, 1*a*, 1*b* and particularly the pumps 2 have the same kind of adjusting and control characteristics, so that they can be operated by similar devices 4, 4*a*, 4*b* and 5, all being suitable for the operation of 10 with the one and only limit-load valve 11 of the system. In the case of a large pressure drop in the load-limit valve 11, the respective pumps 1, 1*a*, 1*b* or 2 will be shifted and pivoted against their string bias towards pumping a large quantity of fluid.

If the control pressure in the pilot output causes one or the other or all of the pumps to pivot in order to increase the respective output, then the situation may arise that the pressure as applied via limit-valve 11 to the respective controller 4*a*, 4*b*, etc., causes the output pressure of the respective pump 1*a*, 1*b*, etc., to exceed maximum pressure on the respective valve 12*a*, 12*b*, etc., so that the respective controller 4*a*, 4*b*, etc., turns the respective pump 1*a*, 1*b*, etc., back until the operating pressure in output line 16*a*, 16*b*, etc., drops below the valve response level. One can say that this is actually the normal state of affairs.

If now the turning structure 7 is in fact being operated, slide 6 is shifted out of the illustrated position and at first the adjusting device 5 for the pump 2 is separated from the load-limit valve 11, via the conduit 18 and by the operation of the thus actuated auxiliary valve 10. Subsequently the adjusting device 5 of the pump 2 is actuated through the switched-over auxiliary valve 10 and through the conduits 21 and 22. Constant pressure will now be applied to 5 through the stop valve 14.

Owing to the high pressure in the pump control, pump 2 causes, through slide 6, the device 7 to receive a maximum in pressurized liquid (quantity). Hence the maximum possible amount pump 2 can liquid (quantity). Hence the maximum possible amount pump 2 can handle is made available in the circuit of for the operation of the turning structure 7. However, the pressure-responsive valve 13, on the other hand, provides a limit here as a maximum may not be needed in all instances. Valve 13 specifically causes the pressure pump 2 to run the turning mechanism 7 during the acceleration phase, by supplying just enough pressure oil at the prescribed pressure as is necessary for operating the turning mechanism, in dependance upon a particular number of revolutions, and the residual power is even then available for use by other users.

Whenever the turning structure and mechanism 7 does not receive any pressurized medium through the control slide 6, then the hydraulic power from pump 2 can be used elsewhere and can be made useful through the downstream valve slide 8$^1$, to be used in the working cylinder $9^1$ or any of the other users. Here, then, auxiliary valve 10 provides for the regular function needed in this regard by operation of the adjusting structure 5.

The invention is not limited to the embodiments described above; but all changes and modifications thereof, not constituting departures from the spirit and scope of the invention, are intended to be included.

I claim:

1. Hydraulic control system for a heavy-duty earth-working machine, such as a hydraulic excavator, hydraulic power shovel or the like, the machine having a structure and mechanism for turning on a vertical axis, as well as a plurality of hydraulically-operated users, comprising:

a plurality of pivotally mounted pressure pumps operating similarly and being respectively associated with said mechanism of said users; a plurality of spring means, each of the pumps being held by a spring-means of the plurality to a relatively small pivot angle but permitting deflection out of that angle upon application of pressure to the respective pump for pivoting the pump, a first one of said pumps being associatable with said turning mechanism;

a load-limit valve producing a particular control pressure;

a pilot pump operating as a measuring or metering pump for providing pressure to the load limit valve, such that a pressure increase or decrease in a controlled fashion obtains, as derivable through the load-limit valve;

a first valve means for individually connecting the load-limit valve to respective pressure pumps of the plurality such that the pilot pump pressure can be made effective in the respective pump of the plurality causing the respective pump to pivot more with increasing pressure;

the respective connections by the valve means obtains when the working pressure of the respective pump as connected to the respective user exceeds the said maximum working pressure whereupon the respective spring means associated with the respective pump retracts the respective pump in order to reduce the amount of fluid conveyed by the respective pump until the working pressure drops below said maximum pressure value;

means for causing said first pump to be selectively connected to or separated from the said loadlimit valve, further causing, on separation, to have a particular pressure applied to the first pump such that maximum pivot angle and maximum fluid pumping obtain;

a particular valve of said first valve means causing the first pump to feed pressure fluid to the turning mechanism; and means for rendering power and pressurized fluid from said first pump available for augmenting the power as provided by the other pumps of the plurality and to augment the amount of pressurized fluid that is being used by at least one of said additional users.

* * * * *